United States Patent [19]

Azcaráte de Morgan et al.

[11] 4,164,086

[45] Aug. 14, 1979

[54] RECTILINEAR SLIDING PANEL DISPLAY FOR SUCCESSIVELY EXPOSING DIFFERENT PRINTED PICTURES

[76] Inventors: Esther Azcaráte de Morgan; David Morgan-Landa, both of Avenida 3 No. 182, Mexico 18, D. F.; José L. Becerra-López, M. Ocaranza No. 107, Mexico 19, D. F., all of Mexico

[21] Appl. No.: 888,134

[22] Filed: Mar. 20, 1978

Related U.S. Application Data

[63] Continuation of Ser. No. 698,550, Jun. 22, 1976, abandoned, which is a continuation of Ser. No. 492,322, Jul. 26, 1974, abandoned.

[30] Foreign Application Priority Data

Jun. 6, 1976 [MX] Mexico ..... 145143

[51] Int. Cl.[2] ..... G09F 11/20

[52] U.S. Cl. ..... 40/476; 40/491

[58] Field of Search ..... 40/476, 491, 488, 508, 40/509

[56] References Cited

U.S. PATENT DOCUMENTS

| | | | |
|---|---|---|---|
| 3,013,352 | 12/1961 | Delfini et al. | 40/491 X |
| 3,080,668 | 3/1963 | Reali | 40/476 |
| 3,373,517 | 3/1968 | Halperin | 40/491 |

FOREIGN PATENT DOCUMENTS

| | | | |
|---|---|---|---|
| 888832 | 12/1971 | Canada | 40/476 |

*Primary Examiner*—John F. Pitrelli

*Attorney, Agent, or Firm*—Armstrong, Nikaido, Marmelstein & Kubovcik

[57] ABSTRACT

The present invention is related to a rectilinear sliding panel display used for displaying pictures and/or messages. A plurality of plate assemblies, each comprising a plurality of plates positioned on top of each other, are provided, wherein the assemblies are positioned adjacent to each other. The adjacent visible plates of the assemblies form the picture and/or message. Also provided are a plurality of links corresponding in number to the plurality of plates. The links are positioned behind the rear face of the plate assemblies, wherein each of the links is coupled to one corresponding plate in each of the plate assemblies. A drive means is provided for sequentially operating the links. The drive means comprises a plurality of stacked rings, each of the rings being coupled to one of the links. A shaft means is provided for sequentially engaging each of the rings and for rotating the ring in response to the rotation of the shaft means. The rotation of the shaft rotates one of the rings, thereby linearly moving the corresponding link. The corresponding plates then slide with respect to the other plates in the plate assemblies.

4 Claims, 15 Drawing Figures

Fig. 1.
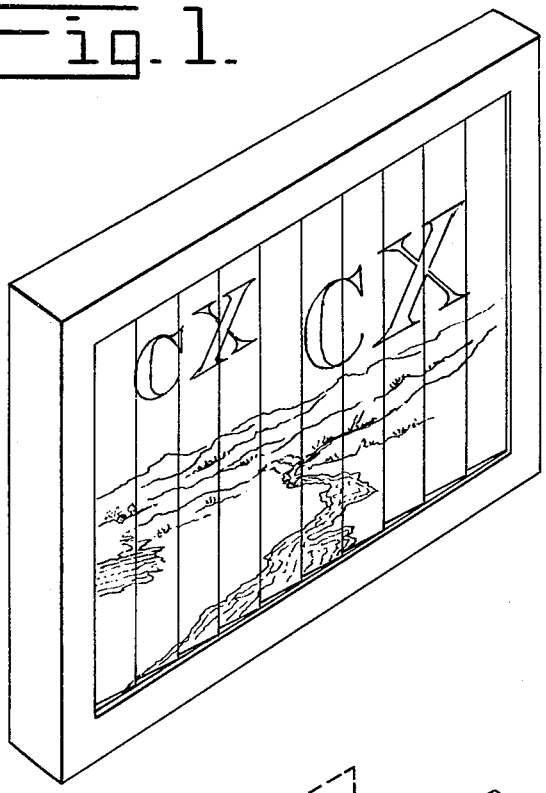
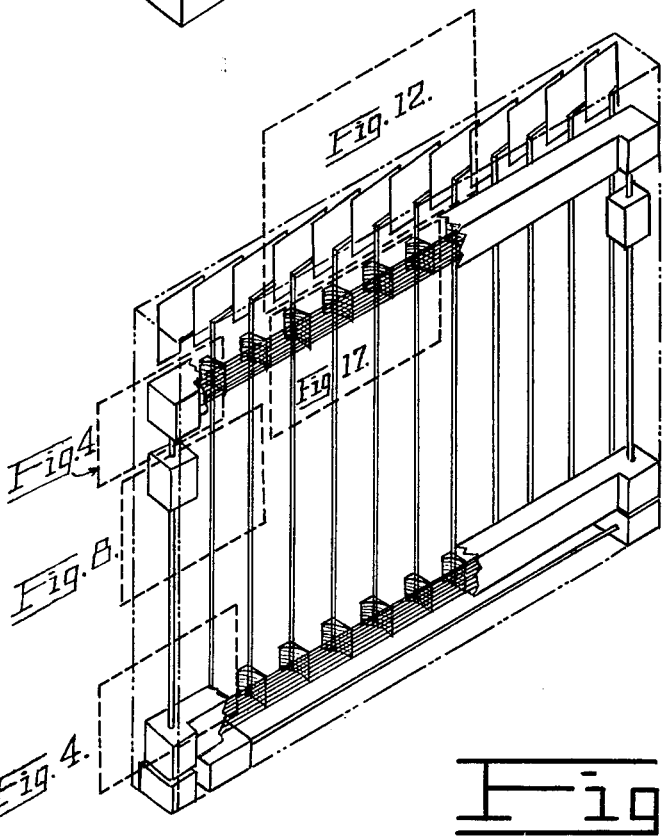
Fig. 2.

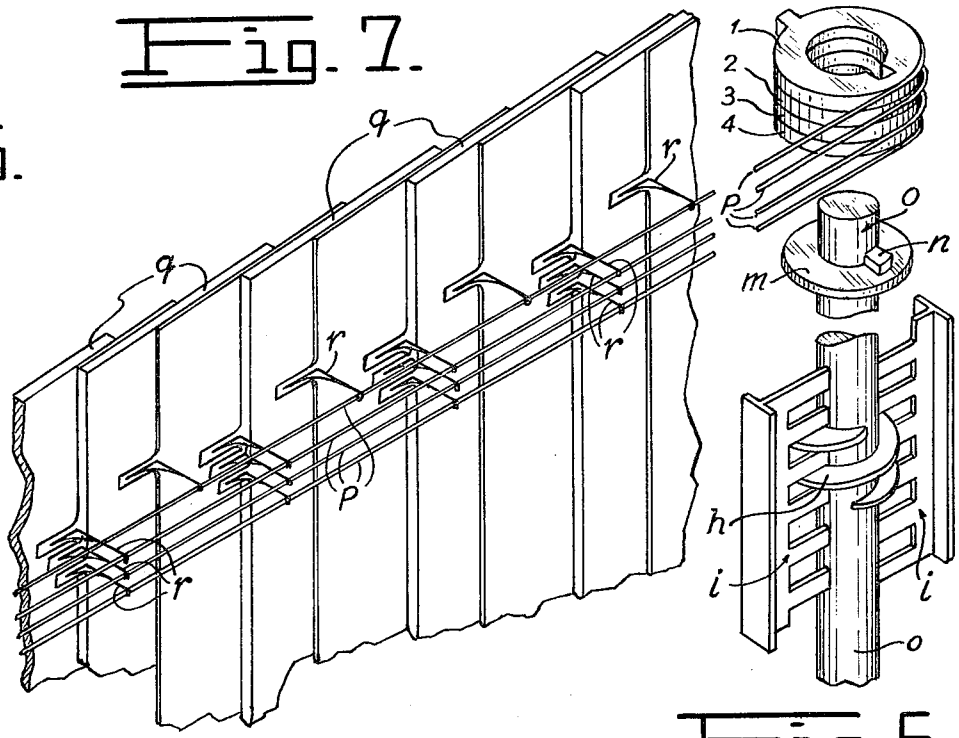
Fig. 3.
Fig. 6.
Fig. 7.
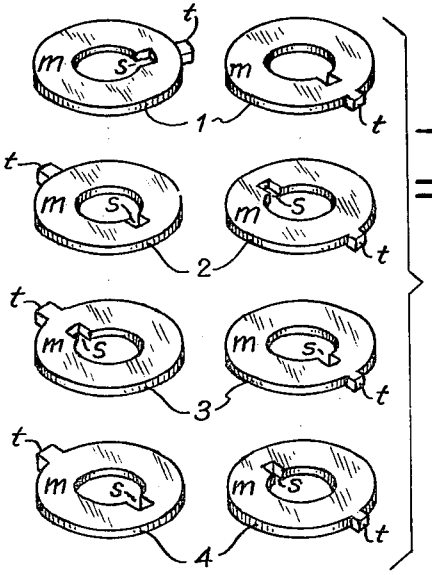
Fig. 5.
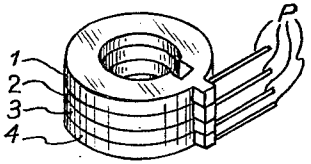
Fig. 4.

RECTILINEAR SLIDING PANEL DISPLAY FOR SUCCESSIVELY EXPOSING DIFFERENT PRINTED PICTURES

This is a continuation of application Serial No. 698,550, filed June 22, 1976 now abandoned, which in turn is a continuation of Ser. No. 492,322 filed July 26, 1974 and also now abandoned.

This invention relates to an improved rectilinear sliding panel display for successively exposing different printed pictures, said apparatus displaying said pictures as vertical strips actuated simultaneously by sliding with respect to each other and carrying small or large printings either in several colors, a single color or in black and white, said material being either sensitized or simply applied by inks or paintings. Said apparatus, due to the shallowness thereof and to the displaying area thereof, possesses great architectural value, since it can be embedded into walls (general panels) or it can be employed as an apparent wall with a color or image changing effect, at a frequency of minutes, hours or days. This apparatus, having many different displays in any size, produces the changes thereof within a twentieth of a second, and the stills thereof with a movie picture frequency (if needed), or stills of a very low frequency, according to the needs of any schedule.

The characteristic details of the rectilinear sliding panel display of this invention are clearly shown in the following disclosure and in the drawings as an illustration therefor, and with the same reference characters serving to identify like parts in the several figures.

FIG. 1 is a perspective view of the outer appearance of the apparatus.

FIG. 2 represents another perspective view of the interior of said apparatus.

FIGS. 3, 4, 5, 6 and 7 show in perspective view sectioned for greater clarity, the drive mechanism of the apparatus of the present invention.

Figure 10:
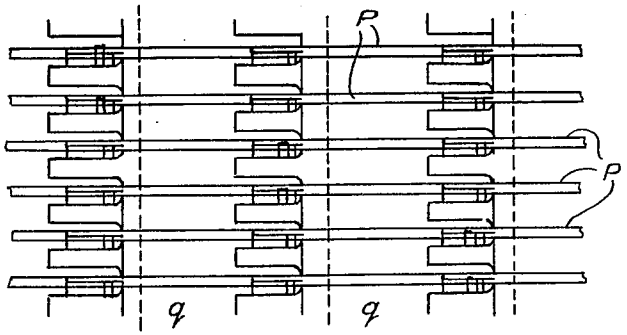
Figure 10A:
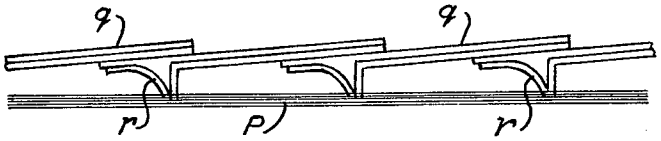

FIGS. 10 and 10*a* show a portion of the plate assemblies of the present invention.

Figure 11:
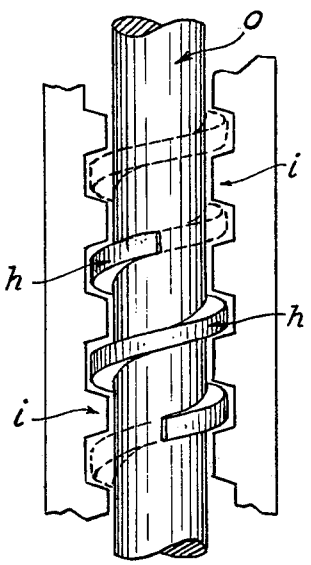

FIG. 11 shows a portion of the drive mechanism of the present invention.

Figure 14:
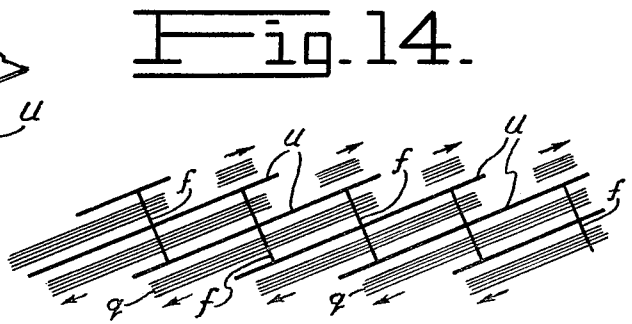
Figure 13:
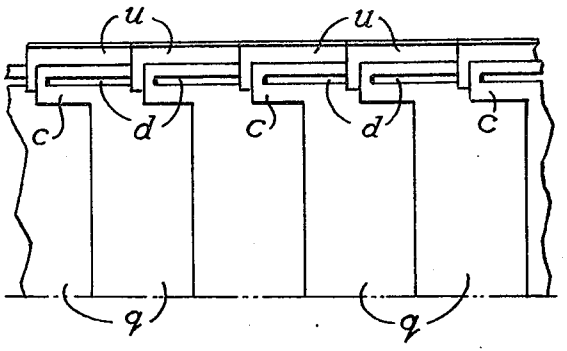
Figure 12:
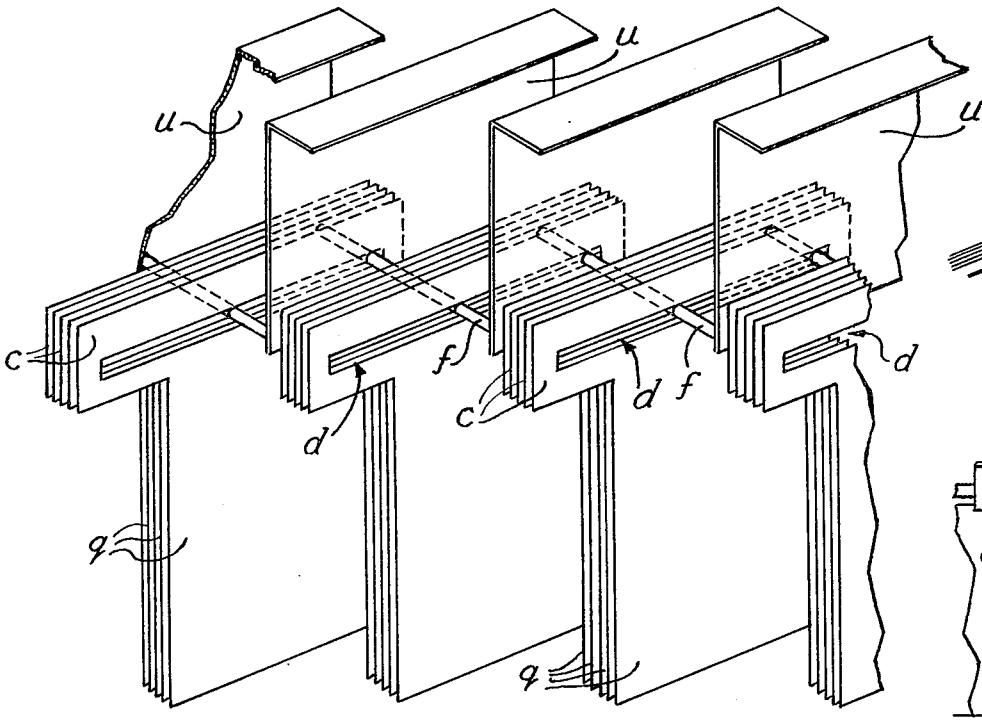

FIGS. 12, 13 and 14 show the plate assemblies and support mechanism of the present invention.

Referring to the drawings, the mechanism comprises: in FIG. 6, a helix h with two turns and a shaft o; in FIG. 7, flexible, links p, lever links r and the sheets formed with the assemblies q; in FIG. 5, rings m characterized by the entering spaces s and the extensions t coupled to the links p, and converting the circular motion in a rectilinear motion through said lever links r; and in FIGS. 3 and 4, the location of paths 1, 2, 3, 4 . . . corresponding to said rings m which are sequentially driven by the prong n emerging from said shaft o.

Figure 9:
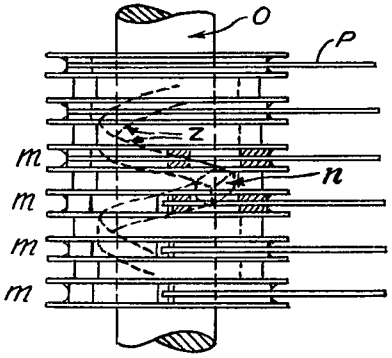
FIGS. 8 and 9 show the shaft and drive mechanism of the present invention.

In FIG. 9, there is shown the positions of said rings m without considering the spinning plane thereof; however, the composite path for the rotating upwardly and downwardly movements is shown as a sinusoid z originated by said prong n integral to said shaft o. In FIG. 11 (as well as in FIG. 8) there are shown the steps for a half-revolution and whole revolution in arc units, both upward and downward, according to the direction of rotation of said shaft o. The circular motion of shaft o is converted into a rectilinear motion by the rack i. FIGS. 10 and 10*a* show the front and top of the sheets formed by the assemblies q, links p and lever links r; wherein every sheet (of said assemblies q) is hinged through its own lever links to its link P, all of which are simultaneously actuated, link after link, according to the pulsating direction of the corresponding ring m.

FIG. 12 shows the supporting plates system u, which engage and lock the cylindrical supports f. Two of the cylindrical supports f engage the slides c along the rectangular spaces or slots d; said spaces d having a width equal to the diameter of said cylindrical supports f and a length equal to twice the width of the face exposed in every displaced sheet in an assembly q. This structure is positioned in the upper portion of the machine, so that the sheets of the assemblies q are under the influence of gravity.

The operation of the apparatus of this invention is as follows:

Irrespective of the material employed, although the description may be directed to one of a plurality of similar elements, all of the corresponding elements have the same motion. In this case, reference is made to a complete display of a printed subject either in colors, monocolor or black and white, in a picture such as shown in FIG. 1. This picture is divided into vertical strips of similar width, the actual width being a function of the overall dimensions of the picture. Every strip, separately, is on a sheet formed on the corresponding assembly q (FIGS. 7, 10 and 10*a*). Every assembly q has an even number of sheets, according to the capacity of the apparatus.

If a sheet assembly q is examined separately, when the first sheet is moved, it is slid downwardly to the one side, thus the following sheet will be displayed; in a second operation, a third sheet will be displayed and so on until the last sheet is displayed. When this state is reached, the order may be reversed, and in the reverse order, the same successive slidings are made until the first state is reached. Each sheet is provided with a contact means comprising a lever link r and a link p (FIGS. 7, 10 and 10*a*), and therefore, is connected to a drive means such as a ring m (FIGS. 3, 4 and 9). In the composition of a complete picture as shown in FIG. 1, with a certain number of vertical strips, there are several sheet assemblies q (FIGS. 7, 10 and 10*a*). The sliding of the corresponding sheets in each assembly q is simultaneous.

Figure 8:
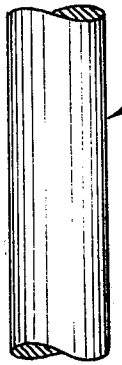

The change over for every complete picture requires a power pulse which is transferred from an energy source through said shaft o, as shown in FIGS. 6, 8 and 11. Every 180° turn (half-rotation) is converted in a vertical step, that is in the direction of the axis of said shaft o, either upward or downward by said rack i, and the two coils of said helix h (FIGS. 6 and 11) according to the direction of rotation. This generates a helical motion of said prong n for every half rotation (180°) of the shaft o, equal to a step upwards or downwards with a length equal to twice the thickness of the ring m. As said rings m are fixed in their spinning plane, said prong n emerging from said shaft o, having the same thickness as said ring m, is inserted in slot s, driven and withdrawn from every ring m, for every half rotation (FIG. 5). This selective half rotation action drives only one ring at a time in an upward or downward order, and all of said rings m but one are sequentially driven according to the direction of said helical motion of the prong n. Thus, for every pulsation, the 180° in one sense and 360° positions in the contrary sense are set (FIGS. 3 and 4) for said rings m (FIG. 5). An identical drive mechanism (not shown) is located on the opposite side of the assemblies q for reversing the direction of movement of the sheets and thus reversing the order in which the sheets are displayed.

For every ring m, there is a sliding motion of the display (FIGS. 7, 10 and 10*a*). The total displaced rectilinear length for every change over is equal to the width of one strip. This length is equal to a half circumference of the path of the anchorings t (FIG. 5), which moves the flexible ends of said links p (FIGS. 7, 10 and 10*a*). For every change over, there is the actuation of: a ring m, a link p and a number of lever links r, according to the strips contained in said display.

The sheet assemblies q (FIGS. 7, 10 and 10*a*) all have a sliding contact overlap in the overposition of which there is no printed image. This position is always hidden and does not affect the total display or the amount of movement.

The force required to slide the sheets acts against friction with the support structure; and when the friction force is not sufficient due to extraordinary reasons, there is provided a slight braking of said rings m.

According to the explanation given, there is shown a system, resisting the changes of the sheet assemblies q, as well as the action of the forces produced by the alternative change over of said assemblies q with the slides c thereof. The position of said plates u remains unchanged at the upper portion of the machine. The cylindrical supports f are fixed to plates u in such a way that each said supports f is journaled to three of said plates u in a horizontal plane, while the plate system u maintains all of its planes vertical and parallel to each other.

Slots d in said slides c provide for limited freedom for the horizontal motion of every sheet of said assemblies q, by an amount twice the width of the printed strips. Every pair of supports f maintains the horizontal line of the movements produced by said system.

What is claimed is:

1. A rectilinear sliding panel display for displaying a plurality of pictures and/or messages, said display comprising:

(a) a plurality of plate assemblies, each comprising a plurality of plates positioned in parallel vertical planes, one behind the other, wherein said assemblies are positioned adjacent to each other;

(b) a plurality of links, said plurality of links corresponding in number to the plurality of plates, said links being positioned behind the rear face of said plate assemblies, wherein each of said links is coupled to one plate in each of said plate assemblies; and (c) drive means for sequentially operating said links, said drive means comprising a plurality of stacked rings, each of said rings coupled to one of said links, shaft means for sequentially engaging each of said rings and for rotating said ring in response to the rotation of said shaft means, whereby the rotation of said shaft means rotates one of said rings, thereby linearly moving the link which is coupled thereto, whereby the plates coupled to said link are moved with respect to the other plates in said plate assemblies, the visible plates in said assemblies forming said picture and/or message.

2. The rectilinear sliding panel display of claim 1, wherein said shaft means comprises a shaft having a projection thereon, a helical coil mounted on said shaft, and a rack for engaging said helical coil, whereby upon the rotation of said shaft, said shaft is shifted linearly due to the engagement of said helical coil and said rack, and wherein each said ring includes a notch which is engaged by said projection.

3. The rectilinear sliding panel display of claim 1, including a plurality of support plates, and cylindrical supports fixed to said support plates and wherein each of said plates includes a slide and a slot in said slide, wherein said cylindrical supports pass through said slides, thereby supporting said plates.

4. The rectilinear sliding panel display of claim 1, wherein a portion of each plate assembly overlaps an adjacent plate assembly.

* * * * *